United States Patent [19]

Kranz

[11] 4,072,264

[45] Feb. 7, 1978

[54] DUPLEX MAILING ENVELOPE

[75] Inventor: Richard Kranz, Prairie Village, Kans.

[73] Assignee: Tension Envelope Corporation, Kansas City, Mo.

[21] Appl. No.: 778,748

[22] Filed: Mar. 14, 1977

[51] Int. Cl.[2] ..... B65D 27/08

[52] U.S. Cl. ..... 229/72; 206/620

[58] Field of Search ..... 229/72, 56, 69; 206/498

[56] References Cited

U.S. PATENT DOCUMENTS

| | | | |
|---|---|---|---|
| 1,163,459 | 12/1915 | Rheutan | 229/72 X |
| 1,545,653 | 7/1925 | Hogan | 229/72 |
| 3,157,344 | 11/1964 | Hennessey | 206/498 X |
| 3,372,861 | 3/1968 | Johnson et al. | 229/80 |

*Primary Examiner*—Stephen P. Garbe

*Attorney, Agent, or Firm*—Fishburn, Gold & Litman

[57] ABSTRACT

A mailing envelope comprises a plurality of interconnected panel members forming a first pocket adapted for receiving a machine inserted enclosure therein, and a second pocket overlapping and smaller in width than the first pocket and adapted for receiving a hand inserted address card therein. A duplex closure flap for sealing said pocket has a perforation line extending from the flap inner edge to the flap outer edge and laterally divides the closure flap into two mutually separable portions, one of which is coincident with the insert opening of the second pocket. Each of said portions includes adhesive sealing means thereon whereby both pockets may be closed by sealing the other closure flap portion, the second pocket being resealably openable by tearingly separating said one closure flap portion from the other along the perforation line.

7 Claims, 7 Drawing Figures

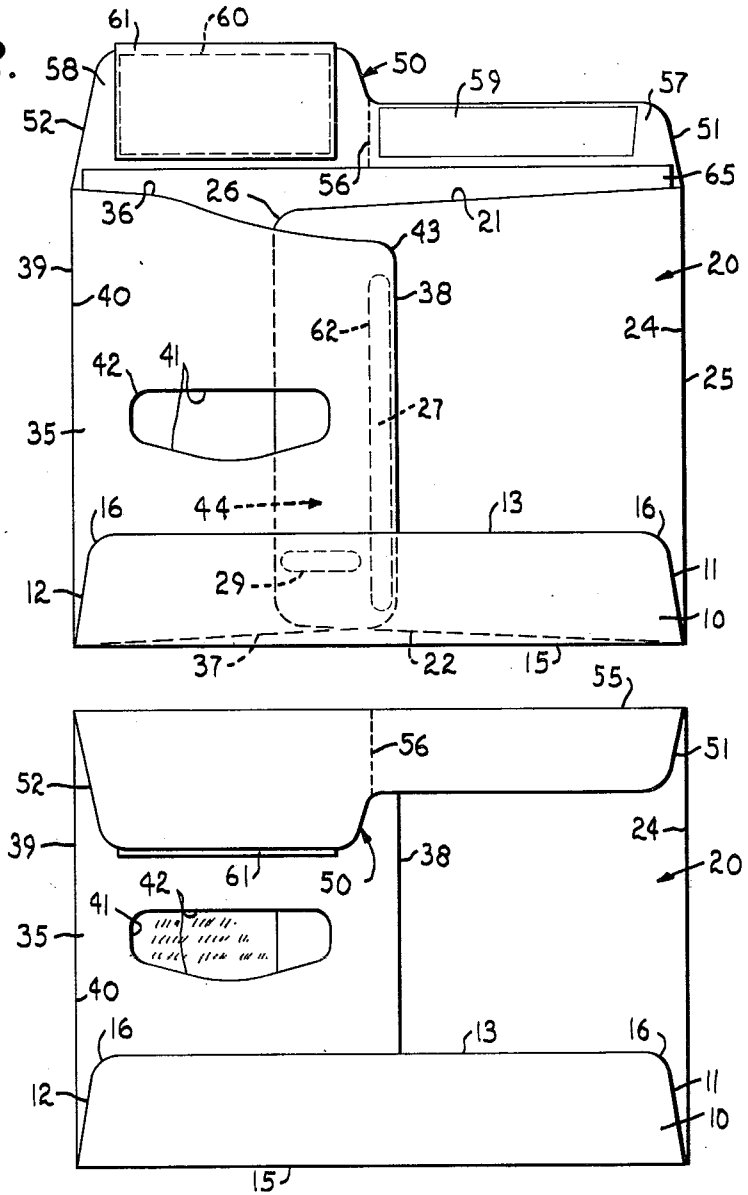
Fig. 2.
Fig. 3.
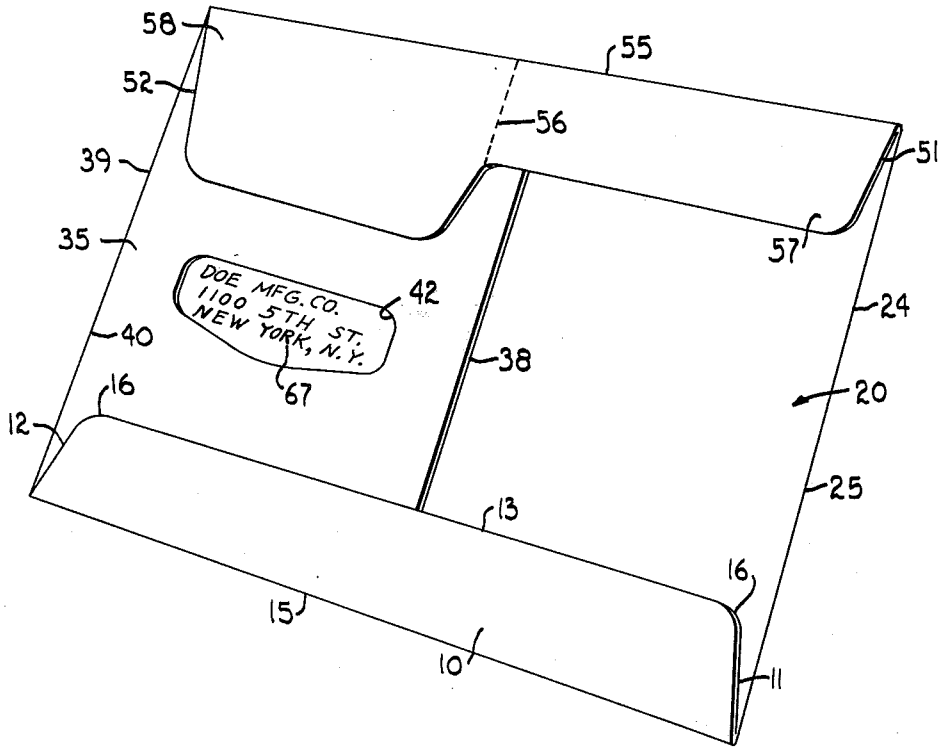
Fig. 1.

DUPLEX MAILING ENVELOPE

This invention relates to mailing envelopes and in particular to duplex envelopes having a multiple segment closure flap.

The principal objects of the present invention are: to provide an envelope closure flap comprising a plurality of laterally, mutually separable portions for the non-contemporaneous opening and closing of an envelope pocket; to provide such an envelope wherein a plurality of pockets are provided, each of which is disposed in substantial registry with at least one of said closure flap portions for the individual opening and closing of each of the several envelope pockets; to provide such an envelope wherein one of said pockets includes a window opening whereby an address card enclosure can be inserted and sealed therein subsequent to the closing of the remaining pockets; to provide such an envelope wherein the window pocket is particularly adapted for the hand insertion of an address card enclosure therein, and the remaining pockets are particularly adapted for the machine insertion of a preprinted enclosure therein; to provide such an envelope wherein overlapping, interconnected side flaps economically form said window pocket; to provide such an envelope wherein an index tab adapted for grasping, provides easy access to the envelope pockets; and to provide such an envelope which is economical to manufacture, and particularly well adapted for the proposed use.

Other objects and advantages of this invention will become apparent from the following description taken in connection with the accompanying drawings wherein are set forth, by way of illustration and example, certain embodiments of this invention.

The drawings constitute a part of this specification and include exemplary embodiments of the present invention and illustrate various objects and features thereof.

FIG. 1 is a perspective view of a duplex mailing envelope embodying this invention, particularly showing a two-part closure flap, a windowed panel member, and an address enclosure disposed within the envelope.

FIG. 2 is a front elevational view of the envelope, shown in an open condition and including an enclosure therein.

FIG. 3 is a front elevational view of the envelope, shown in a closed condition and including an enclosure therein.

Figure 5:
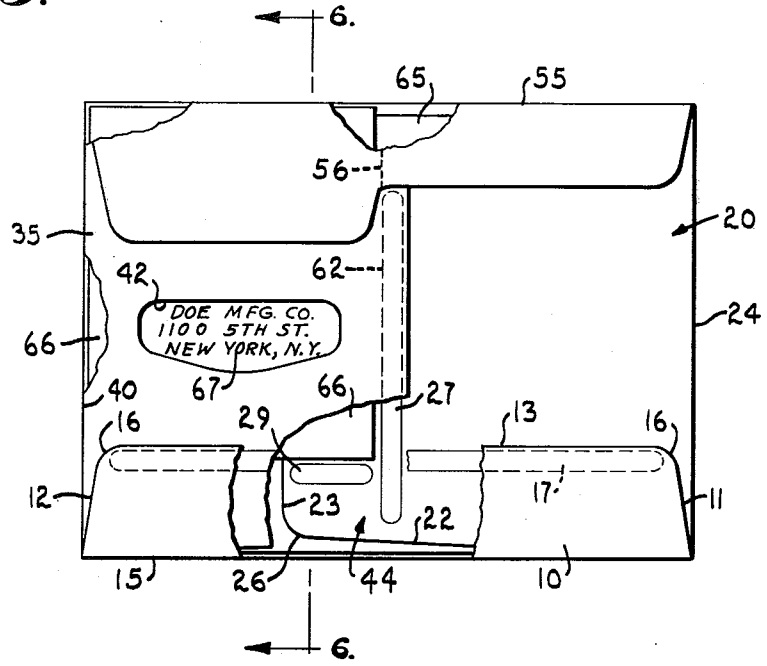
FIG. 5 is a front elevational view of the envelope in a "send" condition, having portions thereof broken away to reveal adhesive strips and the relative positioning of the several enclosures.
Figure 4:
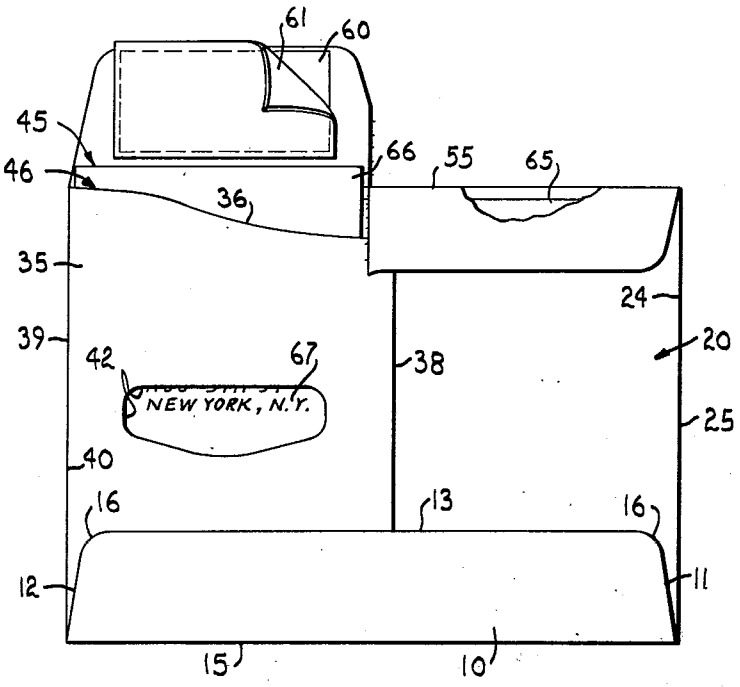
FIG. 4 is a front elevational view of the envelope in a partially reopened condition, a portion thereof being broken away to reveal a first enclosure.

Referring more in detail to the drawings:

The reference numeral 1 generally designates a duplex envelope embodying the present invention, which is particularly well adapted for mailing prepared, printed materials, such as a prospectus, a catalog, an advertising brochure, or the like to a solicitor and/or an inquirer. The envelope 1 includes a substantially rectangular back panel 2 having a top edge 3, a bottom edge 4, and side edges 5 and 6.

A substantially rectangular bottom flap 10 comprising side edges 11 and 12 and an outer edge 13, has an inner edge 14 thereof connected with the back panel bottom edge 4 along a fold line 15. In this example, the bottom flap side edges 11 and 12 taper inwardly toward outer edge 13, and the bottom flap corners 16 are rounded to provide a smooth exterior surface. A gum strip 17 is disposed parallel and adjacent to the outer edge 13 for adhesively attaching said bottom flap to the other envelope panel members.

Figure 7:
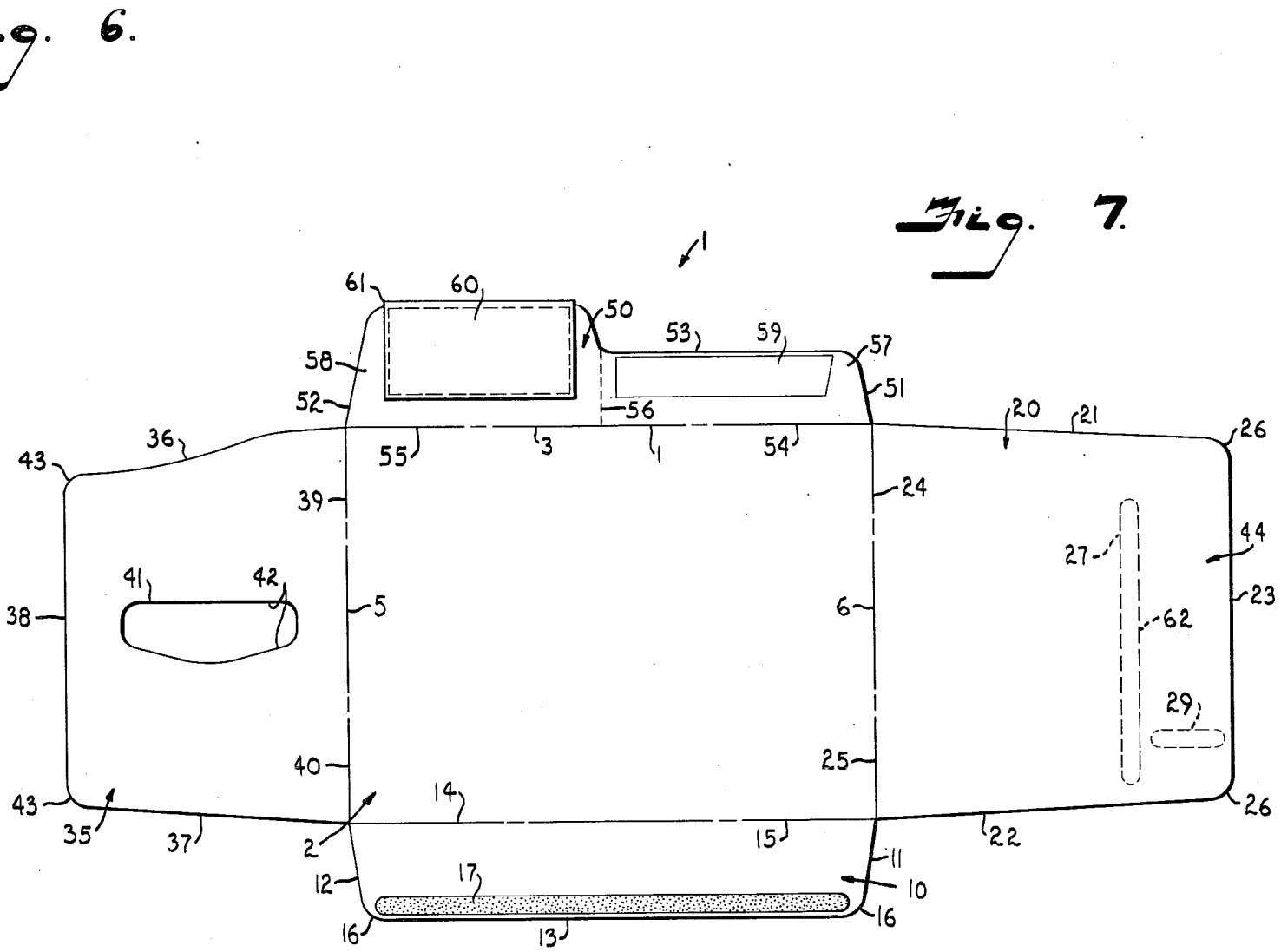
FIG. 7 is a plan view of a blank for producing the envelope, particularly showing the various interconnected envelope panel members, and the adhesive strips thereon.
Figure 6:
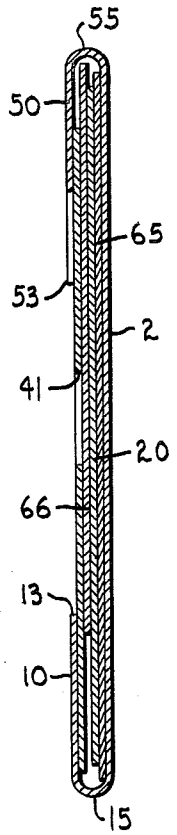
FIG. 6 is an enlarged, vertical, cross-sectional view of the envelope taken along line 6—6, FIG. 5.

A first or right side flap 20, having side edges 21 and 22, and outer edge 23, includes an inner edge 24 connected with the back panel side edge 6 along a fold line 25. The right side flap 20 overlies the back panel 2, and in the illustrated structure, the side edges 21 and 22 taper inwardly toward the outer edge 23 and first side flap corners 26 are rounded. The embodiment illustrated in FIG. 7, shows a first adhesive strip 27 disposed on an exterior surface of the right side flap 20, the strip being parallel to and spaced apart from the outer edge 23. A second adhesive strip 29 is disposed on the exterior surface of right side flap 20 between the first adhesive strip 27 and the outer edge 23. Strip 29 is perpendicular to edge 23 and adjacent the side edge 22.

A second or left side flap 35 includes opposing side edges 36 and 37 and an outer edge 38 and has an inner edge 39 thereof connected with the back panel side edge 5 along a fold line 40. The left side flap 35 includes a centrally disposed window opening 41 therethrough which is bounded by a circumferential ential edge 42. In the illustrated structure, side edge 37 inclines upwardly from fold line 40 to outer edge 38, and the left side flap corners 43 are rounded. Side edge 36 curves convergingly toward side edge 37 from inner edge 39 to outer edge 38, to facilitate the insertion and withdrawal of enclosures from both of the envelope pockets.

The left side flap 35 is folded about line 40 and overlies the remaining portion of back panel 2, as well as an outer portion 44 of the first side flap 20, thereby forming a first or main pocket 45 between back panel 2 and side flaps 20 and 35. The main pocket 45 is particularly well adapted for receiving preprinted, machine inserted, enclosures therein. The right and left side flaps 20 and 35 respectively, overlappingly contact each other such that outer edge 23, which lies between back panel 2 and side flap 35, extends beyond outer edge 38. Further, the side flaps are securely interconnected along interjacently positioned adhesive strips 27 and 29 respectively, and form a second or address card pocket 46 between the outer portion 44 and the side flap 35. The card pocket 46 is defined laterally between fold line 40 and adhesive strip 27, is internal of and communicating with main pocket 45, and is particularly adapted for the hand insertion of an address card therein, whereby address card indicia is retained in substantial registry within the envelope window opening 41. The fist adhesive strip or center seam 27 is disposed parallel and adjacent to the left side flap outer edge 38, a predetermined, spaced apart distance from right side flap outer edge 23. In the illustrated envelope, outer portion 44 is defined by adhesive strip 27, and is in the nature of an interior flap member which overlies approximately one-fourth of the window opening 41. The second adhesive strip 29 is disposed perpendicularly to outer edge 38 and side edge 39 and is spaced apart from back panel bottom edge 4. The adhesive strip 29 is adapted for abutting contact with a bottom edge of the hand inserted address card. It is to be understood that the present invention also contemplates the use of an adhesive spot (not shown) in lieu of strip 29.

The bottom flap 10 overlies both the first and second side flaps 20 and 35, and is connected therewith along adhesive strip 17, thereby forming the bottom for both the main and card pockets 45 and 46.

A closure flap 50, which includes side edges 51 and 52 and an outer edge 53, has an inner edge 54 thereof connected with back panel top edge 3 along a fold line 55. At least one line weakened therealong for separation such as perforated line 56, extends across closure flap 50 from the inner edge 54 to the outer edge 53 and laterally divides the closure flap into two mutually separable portions, such as 57 and 58 respectively. Each of the closure flap portions has adhesive means thereon, as shown, 59 and 60, for sealing contact with one of the envelope panel members. In the illustrated structure, adhesive means 60 is a pressure sensitive substance which is provided with a release coat patch 61 thereover to protect the surface thereof prior to use. Further, perforated line 56, which is rectilinear and disposed perpendicularly to inner edge 54, is in substantial alignment with the innermost edge 62 of first adhesive strip 27, such that the second closure portion 58 is coincident with the insert opening or mouth of the address pocket 46. In this example, the outer edge of second closure portion 58 extends beyond the outer edge of first closure portion 57 to facilitate the sealing of said second closure flap portion.

In use, the preprinted matter to be mailed to potential solicitors, such as enclosure 65, is machine inserted into the envelope main pocket 45 and automatically sealed therein by adhering one of the closure flap portions to one or both of the side flaps. To achieve high speed production, the preprinted matter may be placed upon a precut blank and enveloped by folding the various envelope members about said matter and contemporaneously sealing one of the closure flap portions. Upon customer request or inquiry, the user prepares an address enclosure 66 which includes indicia 67 thereon representing the solicitor's postal address. By pulling upwardly at the outermost edge of the second closure portion 58, said portion is tearingly separated from the sealed first closure portion 57 by detachment along perforated line 56. The address enclosure 66 is then hand inserted into the address pocket 45 using edge 62 and fold 40 as guides, such that the indicia 67 disposed thereon is displayed through window 41. The peripheral edges of the address enclosure 66 are abuttingly retained within address pocket 45, the fold line 40 and adhesive strip 27 preventing sideways card movement and adhesive 29 and top fold line 55 preventing vertical card movement. The release coat patch 61 is then removed from adhesive means 60 and second closure portion 58 is again folded about line 55 and sealed against the envelope panels.

It is to be understood that while certain forms of this invention have been illustrated and described, it is not to be limited to the specific form or arrangement of parts herein described and shown, except insofar as such limitations are included in the following claims.

What is claimed and desired to be secured by Letters Patent is:

1. In a mailing envelope having a front and a back superimposed panels forming a first pocket adapted for receiving an enclosure therein, said first pocket having side edges and at least one free end defining a mouth providing access thereinto, the improvement of:

(a) a mouth closure flap having an inner edge and an outer edge, said inner edge having connection with said first pocket one free edge along a fold line;

(b) a perforated line extending from said flap inner edge to said flap outer edge, and laterally dividing said closure flap into two mutually separable portions;

(c) said closure flap portions each having adhesive thereon for sealing contact with one of said panels, only one of said closure flap portions having a release strip covering the adhesive thereon.

2. An envelope as set forth in claim 1 wherein:

(a) said front panel has an interior surface, and including (b) an interior flap having first, second, third and fourth edges, said first edge being connected with said front panel interior surface and extending generally parallel to said first pocket side edges; at least two of said remaining interior flap edges being free and forming a second pocket between said front panel and said interior flap; and (c) one of said closure flap portions being positioned for sealing said second pocket.

3. An envelope as set forth in claim 1 wherein:

(a) said perforated line is rectilinear and disposed perpendicularly to said closure flap inner edge.

4. An envelope as set forth in claim 1 including:

(a) means associated with said panels forming a second pocket adapted to reveive an enclosure therein, (b) said second pocket having a mouth coextensive with said first pocket mouth whereby said closure flap provides a closure for both of said pockets; and (c) one of said closure flap portions, upon separation along said perforated line, providing selective access into said second pocket while said other closure flap portion maintains at least partial closure of said first pocket.

5. A duplex mailing envelope comprising:

(a) substantially rectangular front and back panels interconnected along side and bottom edges thereof and forming a first pocket having an opening and adapted for receiving a first enclosure therein, means in said first pocket forming a second pocket having an opening coincident with said first pocket opening;

(b) a closure flap having an inner edge and an outer edge; said inner edge having connection with the remaining back panel edge along a fold line, (c) a perforated line extending from said closure flap inner edge to said closure flap outer edge, said perforation line laterally dividing said closure flap into two mutually separable portions, one of said separable portions being positioned to provide access into said second pocket without entirely opening said first pocket;

(d) said closure flap portions each having adhesive means thereon for sealing contact with said front panel, only one of said closure flap portions having a release strip covering the adhesive thereon.

6. An envelope as set forth in claim 5 wherein:

(a) said two mutually separable portions comprise first and second closure flap portions;

(b) said first and second closure flap portions each have an outer edge respectively overlying said first and second side flaps; and (c) said second closure flap outer edge extends a predetermined distance beyond said first closure flap outer edge to facilitate the sealing of said second closure flap portion.

7. In combination, an envelope having a plurality of pockets and a window opening into one of said pockets, an address card with indicia thereon adapted for hand insertion into said one pocket:

(a) said envelope having substantially retangular front and back panels interconnected along right and left side edges and along bottom edges thereof forming a first of said plurality of pockets adapted for receiving a machine inserted enclosure therein;

(b) A closure flap having an inner edge and an outer edge; said inner edge having connection with the remaining back panel edge along a fold line;

(c) a perforated line extending from said flap inner edge to said flap outer edge; said perforated line laterally dividing said closure flap into two mutually separable portions;

(d) said closure flap portions each having adhesive means thereon for sealing contact with said front panel; only one of said closure flap portions having a release strip covering the adhesive thereon (e) said front panel having an interior surface;

(f) an interior flap having first, second, third and fourth edges, said first edge being adhesively connected with said interior surface; said first edge being parallel with said front panel right and left side edges; the remaining interior flap edges being free and forming a second pocket between said front panel and said interior flap, said second pocket being laterally bounded by said front and back panel left side edges and by said first edge;

(g) said first edge being in substantial alignment with said perforated line; and (h) said second pocket having said address card removably, hand inserted and retained therein, whereby said address card indicia is retained in substantial registry within said window opening.

* * * * *